US011225350B1

(12) United States Patent
Koch et al.

(10) Patent No.: US 11,225,350 B1
(45) Date of Patent: Jan. 18, 2022

(54) SHAPE-CONFORMING TAMP PAD

(71) Applicants: Paul F. Koch, Morris, NY (US); Julianne P. Koch, Morris, NY (US)

(72) Inventors: Paul F. Koch, Morris, NY (US); Julianne P. Koch, Morris, NY (US)

( * ) Notice: Subject to any disclaimer, the term of this patent is extended or adjusted under 35 U.S.C. 154(b) by 0 days.

(21) Appl. No.: 16/998,261

(22) Filed: Aug. 20, 2020

Related U.S. Application Data

(60) Provisional application No. 62/891,248, filed on Aug. 23, 2019.

(51) Int. Cl.
*B65C 9/26* (2006.01)
*B65C 9/18* (2006.01)
*B65C 9/36* (2006.01)

(52) U.S. Cl.
CPC ..... *B65C 9/26* (2013.01); *B65C 9/183* (2013.01); *B65C 9/36* (2013.01)

(58) Field of Classification Search
CPC combination set(s) only.
See application file for complete search history.

(56) References Cited

U.S. PATENT DOCUMENTS 3,888,725 A 6/1975 French
5,300,181 A * 4/1994 Yamaguchi ..... B65C 1/042 156/542
5,304,264 A 4/1994 Wehrmann
5,885,406 A 3/1999 Tiefel
6,006,808 A * 12/1999 Ewert ..... B65C 9/28 156/556
6,321,814 B1 * 11/2001 Tracy ..... B65C 1/02 156/556
6,440,249 B1 * 8/2002 Swinburne ..... B65C 9/183 156/230
6,845,800 B2 1/2005 Dods et al.
8,282,754 B2 10/2012 Lorence et al.
8,738,177 B2 5/2014 Van Ooyen et al.
9,721,418 B2 8/2017 Van Ooyen et al.

FOREIGN PATENT DOCUMENTS

AU 2003204044 A1 12/2003

OTHER PUBLICATIONS https://www.domino-printing.com/en/blog/2018/what-is-print-and-apply-labelling, retrieved Aug. 18, 2020.
https://www.cab.de/en/marking/print-apply/hermesplus-applicators/4214/ retrieved Aug. 18, 2020.

(Continued)

*Primary Examiner* — Carson Gross

(57) ABSTRACT

A label-affixing device includes a plate and a shape-conforming tamp pad. The plate is configured to move between a first position and a second position. The shape-conforming tamp pad includes a base structure including a first surface and a second surface opposite the first surface. The shape-conforming tamp pad further includes appendages extending from the second surface of the base structure. The first surface of the shape-conforming tamp pad is mounted to the plate. The appendages are configured to at least one of individually compress or individually deform to apply an adhesive label to a non-planar surface of an object responsive to the plate moving from the first position to the second position.

20 Claims, 7 Drawing Sheets

(56) References Cited

OTHER PUBLICATIONS https://www.weber-marking.com/labelling/label-printers-and-dispensers.html, retrieved Aug. 18, 2020.
http://www.labelingnews.com/2014/03/pneumatic-or-electronic-for-your-label-printer-applicator/, retrieved Aug. 18, 2020.
http://foxiv.com/applications/tamp-label-application/ retrieved Aug. 18, 2020. retrieved Aug. 18, 2020.
https://www.amazon.com/Swingline-Rubber-Finger-12-Pack-S7054033C/dp/B00007LB0H, retrieved Aug. 18, 2020.
https://www.bustle.com/p/the-5-best-silicone-sponges-16034816, retrieved Aug. 18, 2020.
https://www.pjpmarketplace.com/carlisle-pastry-brush-2in-red.html, retrieved Aug. 18, 2020.

* cited by examiner

SHAPE-CONFORMING TAMP PAD

REFERENCE TO RELATED APPLICATIONS

The present application claims the benefit of priority to U.S. Provisional Application No. 62/891,248 filed Aug. 23, 2019, the disclosure of which is incorporated herein by reference in its entirety for all purposes

TECHNICAL FIELD

The present disclosure generally relates to application of labels, and more specifically, relates to apparatus and methods for applying a label to an object.

BACKGROUND

Labels are used for various purposes, including for household uses to large production uses. Labels can be made of various materials and in different shapes. Labels can be separately produced and applied on various objects. The objects can be of different shapes and materials. For example, labels may be placed on paper, plastic, metal, packages, bottles, books, toys, etc. Objects may be in different shapes, such as non-planar surfaces, dome-shaped, uneven surfaces, cylindrical, etc.

BRIEF DESCRIPTION OF THE DRAWINGS

The present disclosure will be understood more fully from the detailed description given below and from the accompanying drawings of various implementations of the disclosure.

DETAILED DESCRIPTION

Figure 1B:
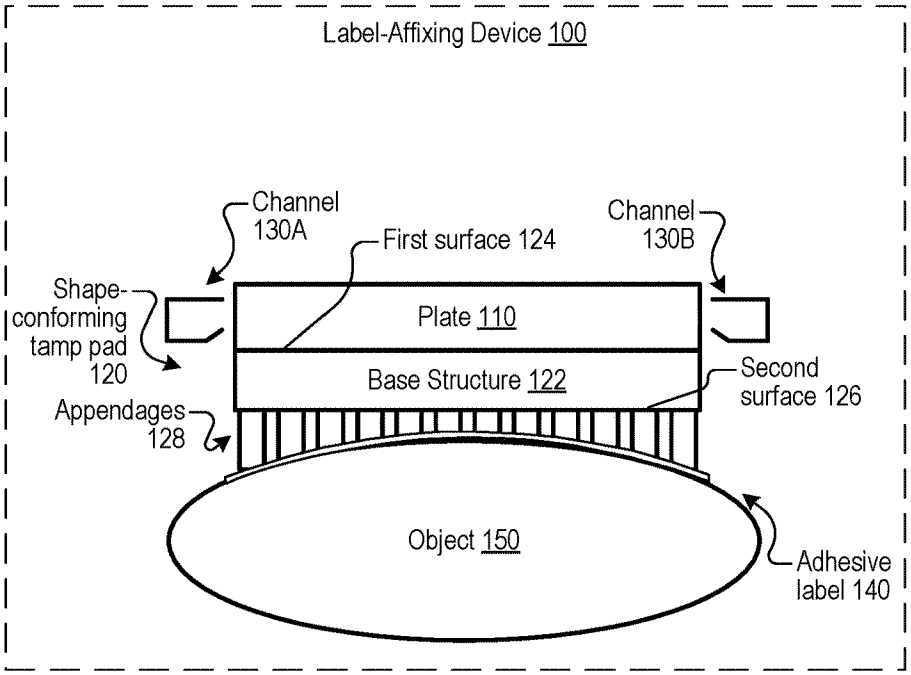
FIGS. 1A-1B illustrate side views of a label-affixing device in accordance with some embodiments of the present disclosure.

Aspects of the present disclosure are directed to a shape-conforming tamp pad. Labels may come in various shapes and materials. For example, labels can include paper, fabric, metal, etc. Some labels are prepared (e.g., printed, crafted, etc.) and stored prior to being applied on an object. Some labels may be stored on a roll of backing material. Some labels may have an adhesive side that is designed to attach the label to an object. A label with an adhesive side is often referred to as a self-adhesive label. It is common to store self-adhesive labels on a strip of backing material and keep the strip wrapped around itself or around a spool (e.g., in a roll). Some labels are prepared at the same time or immediately before being applied on an object. For example, an apparatus may be designed to print a label immediately before the label is to be dispensed and applied on an object. In some cases, the material on which the label is printed may be stored on a roll. In some cases, labels may be placed on an object first and afterwards be secured on the object with an attaching or fastening material, such as an adhesive material applied over the label with a tape, staples, pins, etc.

A labeling apparatus can be used to assist with the application of a label. Some apparatuses may be used to detach the label from the backing material. Some may be used to affix the label to an object. For self-adhesive labels, one of the challenges of label application is handling the label after removing the adhesive side of the label from the backing material and prior to applying it on the object. Since removal from the backing material exposes the adhesive side of the label, the label needs to be handled with caution. There is risk of the adhesive side coming in contact with parts of the labeling apparatus, or other surrounding objects. This can disintegrate the shape of the label, cause unintended elements (e.g., particles, debris, etc.) to be adhered to the adhesive side of the label, and/or tangle the label (e.g., with other objects, with itself, etc.), causing errors in the application of the label. An effort to alleviate the problem with contacting the adhesive side may be made by avoiding touching the adhesive side with any parts of the labeling apparatus. One technique is to use air suction through a planar holding tool (e.g., vacuum tool, suction plate, etc.) to hold the label by the non-adhesive side of the label prior to application of the label. Conventionally, for the air suction to adequately hold the label, the planar holding tool is rigid and flat, making applying labels to curved surfaces, uneven surfaces, or recessed surfaces difficult or impossible in conventional systems. Some systems use a high-pressure blast of air to transfer the label from the planar holding tool to the curved surface or recessed surface of an object. However, various challenges are involved with such a solution. Conventional systems use a planar holding tool on the non-adhesive side for holding the label via air suction, which limits or eliminates space on the non-adhesive side for other types of tools to control the application of the label, especially for non-standard shaped objects which could benefit from extra support during application of the label. In conventional systems, a planar holding tool involves complex designs, inconvenient supporting structure, and expensive materials. For example, a conventional vacuum planar holding tool has a pneumatic mechanism, structures, and a source of compressed air, which occupies room and is not usable in many applications (e.g., table-top labeler, in a smaller setup, such as at home or a small business). Further, such a device can be expensive, especially for a small business or an everyday user. The same challenges and limitations apply to conventional systems that use a high-pressure blast of air to apply a label to an object.

Aspects of the present disclosure address the above and other deficiencies by using a shape-conforming tamp pad for application of a label on an object. The shape-conforming tamp pad includes a base structure and appendages that extend from the lower surface of the base structure. The appendages are configured to individually compress and/or individually deform to apply an adhesive label to a non-planar surface (e.g., uneven surface, curved surface, recessed surface, etc.) of an object. In some embodiments, a recessed surface can include a planar surface within the recess.

In some embodiments, the shape-conforming tamp pad is used within a label-affixing device. The label-affixing device includes a plate configured to move between a first position and a second position and the shape-conforming tamp pad is mounted to the plate. As the plate moves from the first position to the second position, the appendages on the tamp pad individually compress and/or individually deform to apply an adhesive label to a non-planar surface of an object.

The systems, devices, and methods disclosed herein have advantages over conventional solutions. Because a label-affixing device using the shape-conforming tamp pad may not use a vacuum system or a source of compressed air, the label-affixing device uses less space than conventional label applicators that use either air suction or a blast of air to apply a label. This makes the shape-conforming tamp pad advantageous for use in a home or small business where air suction and/or air-blasting equipment is not easily available and/or space for the air suction and/or air-blasting equipment is not available. The shape-conforming tamp pad can be used to apply labels to objects of various shapes, including objects with curved, uneven, or recessed surfaces, while a conventional rigid tamp pad would be ineffective in these cases. Not only can the shape-conforming tamp pad be used to apply labels to various shaped objects, the same shape-conforming tamp pad can be used for different objects. In a conventional system, one or more components would need to be switched out if the machine were to start applying labels to an object of a different shape (e.g., type of surface). Because the shape-conforming tamp pad can bend and conform to various objects, the same shape-conforming tamp pad can be used to apply labels to different shaped objects (e.g., without switching components like conventional systems). The shape-conforming tamp pad may be configured to press down a label in a manner which reduces the chances that air bubbles will be trapped under the label (e.g., between the label and the object). The shape-conforming tamp pad also causes corresponding labels to be applied consistently to the same area of corresponding objects, thus improving over applying the labels by hand which introduces inconsistencies.

Figure 1A:
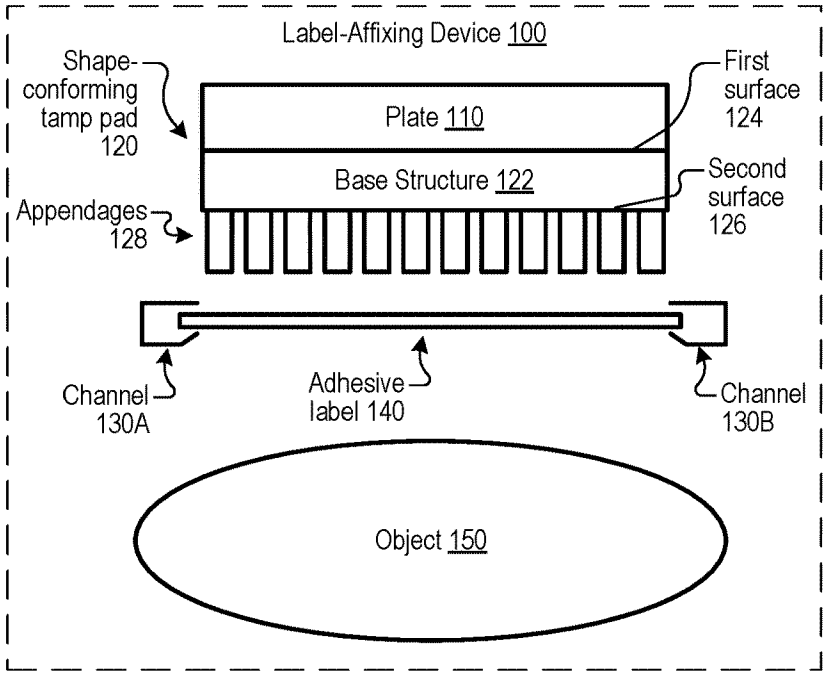

FIGS. 1A-1B illustrate side views of a label-affixing device 100 in accordance with some embodiments of the present disclosure. The label-affixing device 100 may include a plate 110, shape-conforming tamp pad 120, and channel slides 130A and 130B of a channel slide mechanism. The plate 110 is configured to secure a base structure 122 of the shape-conforming tamp pad 120. For example, a lower planar surface of the plate 110 can be secured to an upper planar surface of the base structure 122. The base structure 122 of the shape-conforming tamp pad 120 can be secured to the plate 110 by various suitable means, including screws, fasteners, adhesive, pneumatic suction, or the like. The plate 110 can be coupled to a mechanism or an actuator for moving the plate 110 between a first position (as depicted in FIG. 1A) and a second position (as depicted in FIG. 1B). When the plate 110 is moving from the first position to the second position, a lower surface of the shape-conforming tamp pad 120 makes contact with an adhesive label 140 that is secured by the channel slides 130A and 130B. The lower surface of the shape-conforming tamp pad 120 can include appendages 128 in some embodiments. The contact between the lower surface of the shape-conforming tamp pad 120 and the adhesive label 140 causes the adhesive label 140 to flex (e.g., bend or have a slight curvature) and be released from the channel slides 130A and 130B. At the second position, the lower surface of the shape-conforming tamp pad 120 causes the adhesive label 140 to come into contact with and adhere to an object 150. The lower surface of the shape-conforming tamp pad 120 applies a pressure between the adhesive label 140 and the object 150, such that the adhesive label 140 adheres to the object 150. In some embodiments, the plate 110 includes an upper surface and the lower surface. The lower surface of the plate 110 can have substantially the same size (e.g., the same area) as the upper surface of the base structure 122. In other embodiments, the size of the lower surface of the plate 110 can be smaller or larger than the size of the upper surface of the base structure 122. The plate 110 can be constructed of a sufficiently rigid material, such as a metal, plastic, rubber, ceramic, or the like. In some embodiments, the plate 110 can include or be coupled to a mechanism to adjust a temperature of the plate and/or the shape-conforming tamp pad 120, for example to apply heat to the adhesive label 140 during application of the adhesive label 140 to the object 150. A longitudinal dimension of the plate 110 (e.g., measured in a direction that is perpendicular to a length of the channel slides 130A and 130B) can be less than a distance between the channel slide 130A and the channel slide 130B to allow the plate 110 to pass through the gap when moving between the first position and the second position. The plate 110 can be positioned to be centered between the channel slides 130A and 130B. In some embodiments, the plate 110 includes a recessed area to which the shape-conforming tamp pad 120 can be fixed in order to prevent the shape-conforming tamp pad 120 from being shifted along the lower surface of the plate 110.

The shape-conforming tamp pad 120 may be attached (e.g., removably attached, permanently attached) to the plate via an adhesive and/or by one or more mechanical fasteners (e.g., screws, bolts, clips, nails, etc.). The shape-conforming tamp pad 120 may include the base structure 122 with a first surface 124 that is attached to the plate 110 and a second surface 126 from which appendages 128 extend.

In some embodiments, the base structure 122 can be constructed of a rigid material, such as metal, plastic, ceramic, or the like, or a compressible material (and/or a deformable material), such as rubber, foam, silicone, or the like. In some embodiments, when the base structure 122 is constructed of a compressible material (and/or deformable material), the appendages 128 can be integral to the base structure 122 and constructed of the same material. In other embodiments, the appendages 128 can be adhered or fixed to the base structure 122, and can be constructed of the same material or different material as the base structure 122. In general, the appendages 128 can be any flexible, compressible, and/or deformable material, including silicone, foam, rubber, springs, gas, fluid, or the like.

Figure 3A:
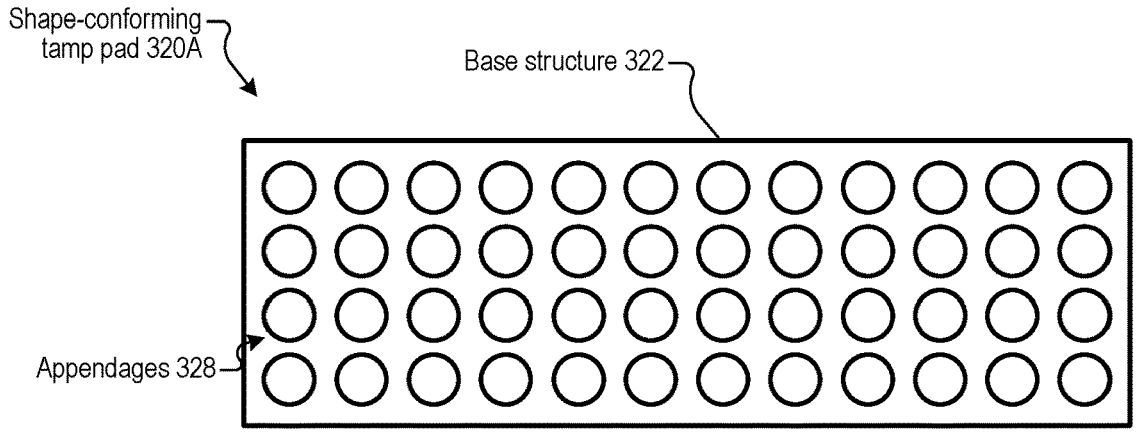
FIGS. 3A-3H illustrate various shape-conforming tamp pads in accordance with some embodiments of the present disclosure.
Figure 3B:
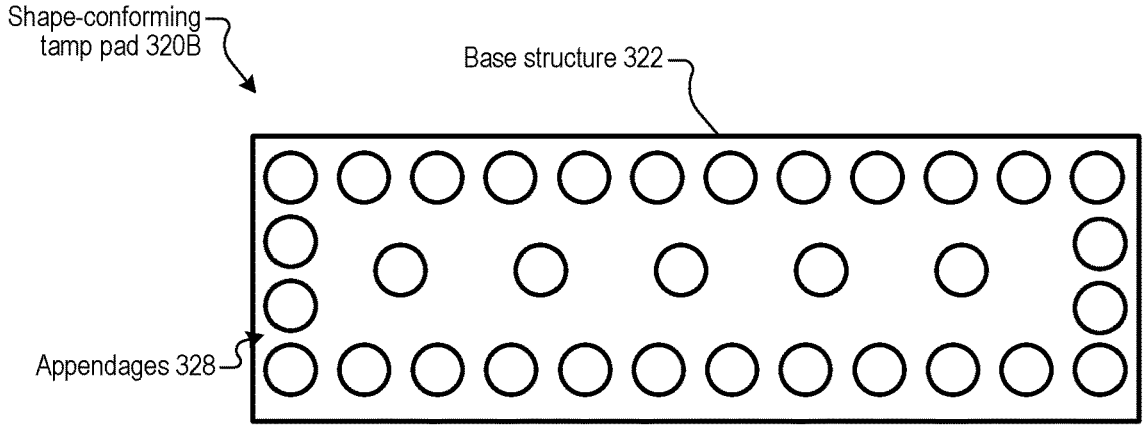
Figure 3C:
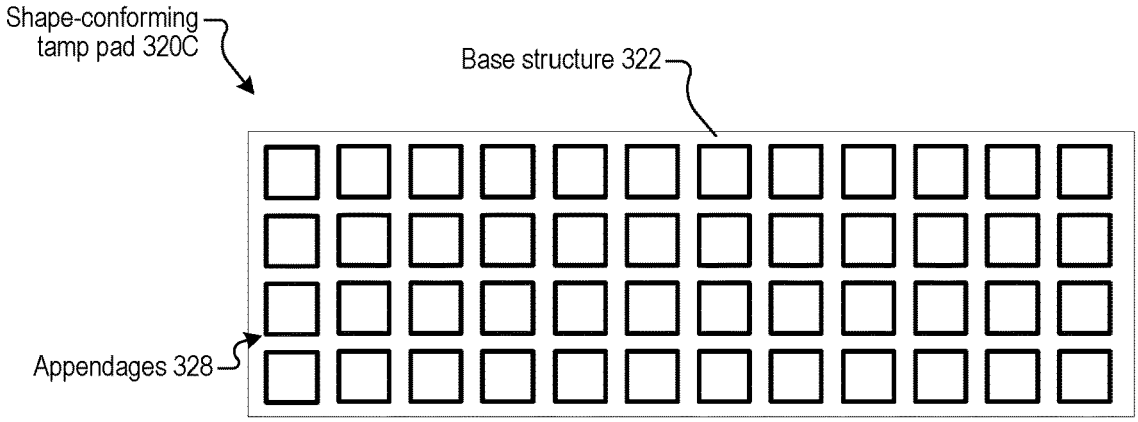
Figure 3D:
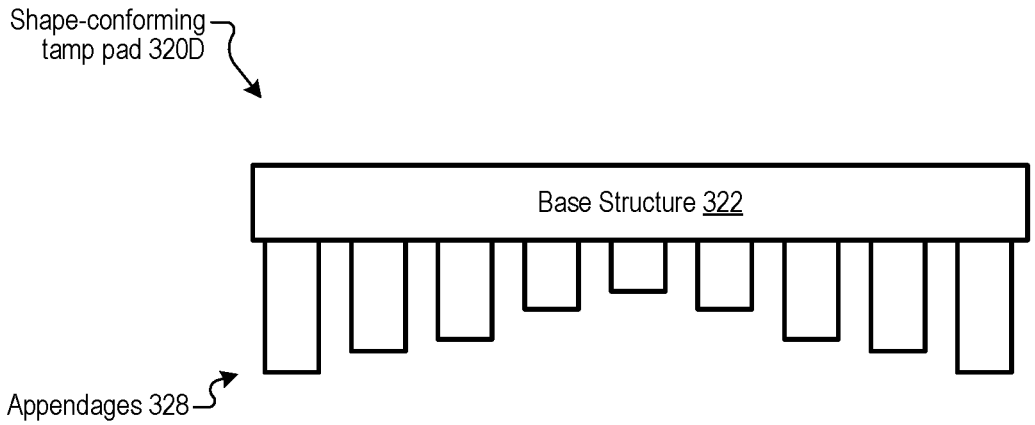
Figure 3E:
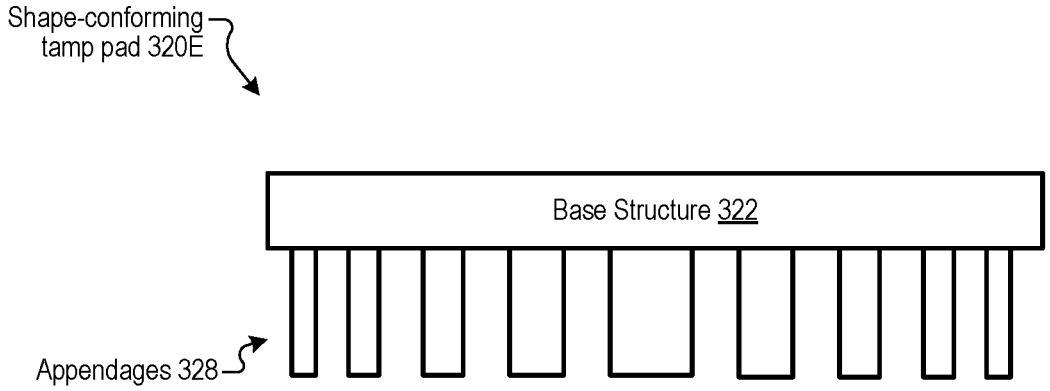
Figure 3F:
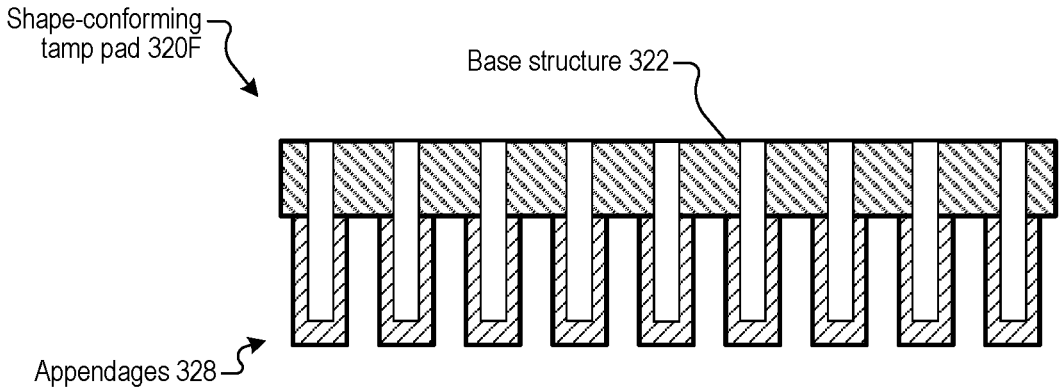
Figure 3G:
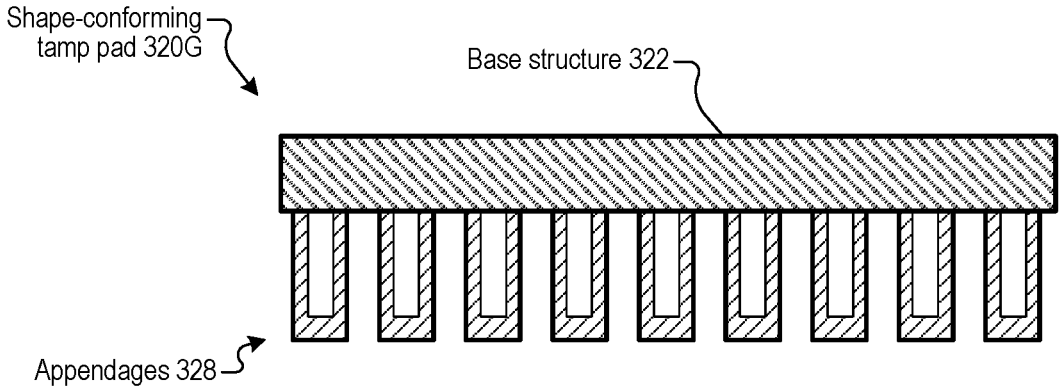
Figure 3H:
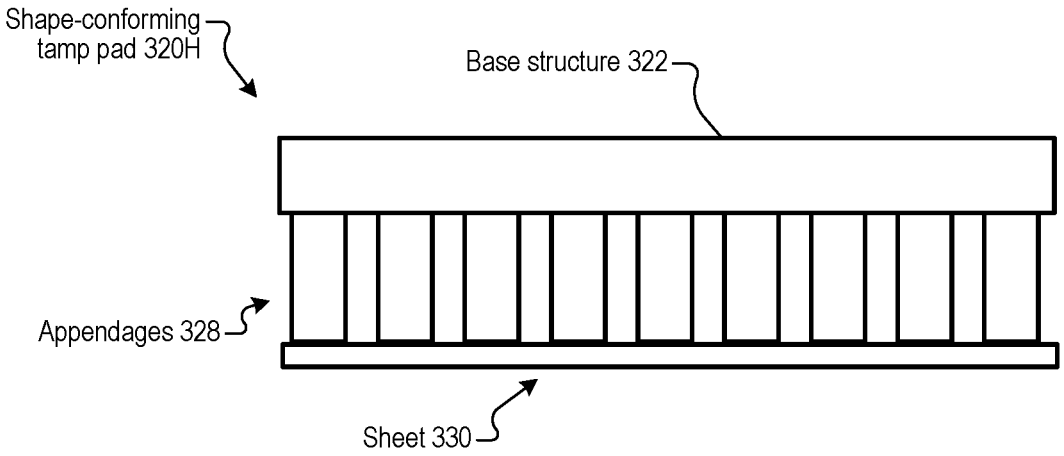

In some embodiments, one or more components of the label-affixing device 100 (e.g., shape conforming tamp pad 120, base structure 122, appendages 128, sheet 330 of FIG. 3H, etc.) are configured to undergo change in size and/or shape responsive to application of a force (e.g., and return to substantially the same original size and/or shape after stopping the application of the force). In some embodiments, this change in size and/or shape includes one or more of deformation (e.g., change in size or shape), displacement (e.g., absolute change in position of a point on an object), deflection (e.g., relative change in external displacements on an object), strain (e.g., relative internal change in shape of one or more portions of internal material), stress, temporary or elastic deformation, compression (e.g., reduction in size in one or more directions, relative volume change in response to pressure), tension or traction (e.g., application of balanced outward pulling forces), shearing (e.g., displacing layers of the material parallel to each other), uniaxial compression (e.g., a substantial amount of forces acting on the material are directed along one direction), biaxial compression (e.g., compressive forces in multiple directions, such as inwards along edges or over a side surface, etc.), being flexible (e.g., capable of being bent without breaking), being pliable, being bendable, and/or the like.

In some embodiments, the pressure that is applied between the adhesive label 140 and the object 150 can depend on various factors of the shape-conforming tamp pad 120 including the base structure 122 and the appendages 128. For example the pressure that is applied can be varied (e.g., made higher or lower) based on the shape, size, density, hardness, flexibility, and the like of the lower surface of the shape-conforming tamp pad 120. When the lower surface of the shape-conforming tamp pad 120 includes the appendages 128, the pressure can be varied by adjusting the thickness, density, spacing, material, and the like of the appendages 128, as described herein. In addition, the pressure can be made to vary at different locations within a perimeter of the lower surface of the shape-conforming tamp pad 120, for example by adjusting the thickness, density, spacing, material, or the like of the appendages within the perimeter of the lower surface.

In FIG. 1A, the plate 110 and shape-conforming tamp pad 120 are in the first position above the adhesive label 140. In some embodiments, the adhesive label 140 is held by a pair of channel slides 130A and 130B. The object 150 to which the adhesive label 140 is to be applied is located below the adhesive label 140. The object 150 may have a planar surface, a non-planar surface, an uneven surface, a recessed surface, and/or the like. The object 150 may be a plastic container, a shipping crate, a bottle, a bucket, a package, an envelope, etc.

FIG. 1B illustrates the plate 110 and shape-conforming tamp pad 120 in the second position in which the label 140 is applied to a surface of the object 150. The appendages 128 can be individually compressed and/or individually deformed depending on a profile of the surface of the object 150, in order to conform the adhesive label 140 to the surface of the object 150. This can allow for applying the adhesive label 140 to the object 150 without applying excessive pressure that could cause the object 150 to deform. As depicted in FIGS. 1A-B, the object 150 has an upper surface and a lower surface. The upper surface of the object 150 includes a first portion to which the adhesive label 140 will be or can be affixed. The lower surface of the object 150 is opposite the upper surface of the object 150. A second portion of the upper surface is located within a first distance from a center of the upper surface and a third portion of the upper surface is located at a second distance, greater than the first distance, from the center of the upper surface. It is worth noting that the first portion, the second portion, and the third portion are not necessarily mutually exclusive. In other embodiments, the second distance can be less than the first distance. In other embodiments, the second distance can be the same as the first distance.

In one embodiment, a first subset of the appendages 128 that are above the second portion of the upper surface of the object 150 compress and/or deform more than a second subset of the appendages 128 that are above the third portion of the upper surface of the object 150. In some embodiments, the same shape-conforming tamp pad 120 can be used to apply the adhesive label 140 to a different object that has an upper surface that is different from the upper surface of the object 150. In one embodiment, the object can be an object where a first surface located proximate the center of the upper surface is lower than one or more second surfaces located proximate a perimeter of the object. In some embodiments, the same shape-conforming tamp pad 120 can be used to apply the adhesive label 140 to an object that has a planar surface (e.g., the appendages 128 may substantially uniformly compress and/or uniformly deform).

In some embodiments, the adhesive label 140 has at least one dimension (in a direction measured between channel slides 130A and 130B) that is substantially similar or slightly longer than a distance (e.g., the shortest distance) between the channel slides 130A and 130B. The one dimension that is slightly longer than the distance allows the adhesive label 140 to be held in an appropriate position before being applied. In some embodiments, the adhesive label 140 is positioned such that a center of the adhesive label 140 is located approximately halfway between the channel slides 130A and 130B.

It should be noted that although in FIGS. 1A-1B the object 150 is depicted as being below the adhesive label 140 and channel slides 130A and 130B, in other embodiments, the label-affixing device 100 can have a different configuration in order to apply a label to an object that is located elsewhere, such as above or next to the label-affixing device. For example, in the case where the label-affixing device applies a label to an object next to it (e.g., the label-affixing device and the object may be located on the same tabletop), the channel slides may be positioned vertically in order to hold the label in a vertical position, and the plate and shape-conforming tamp pad can also be positioned vertical in order to apply the label to the object.

Figure 2:
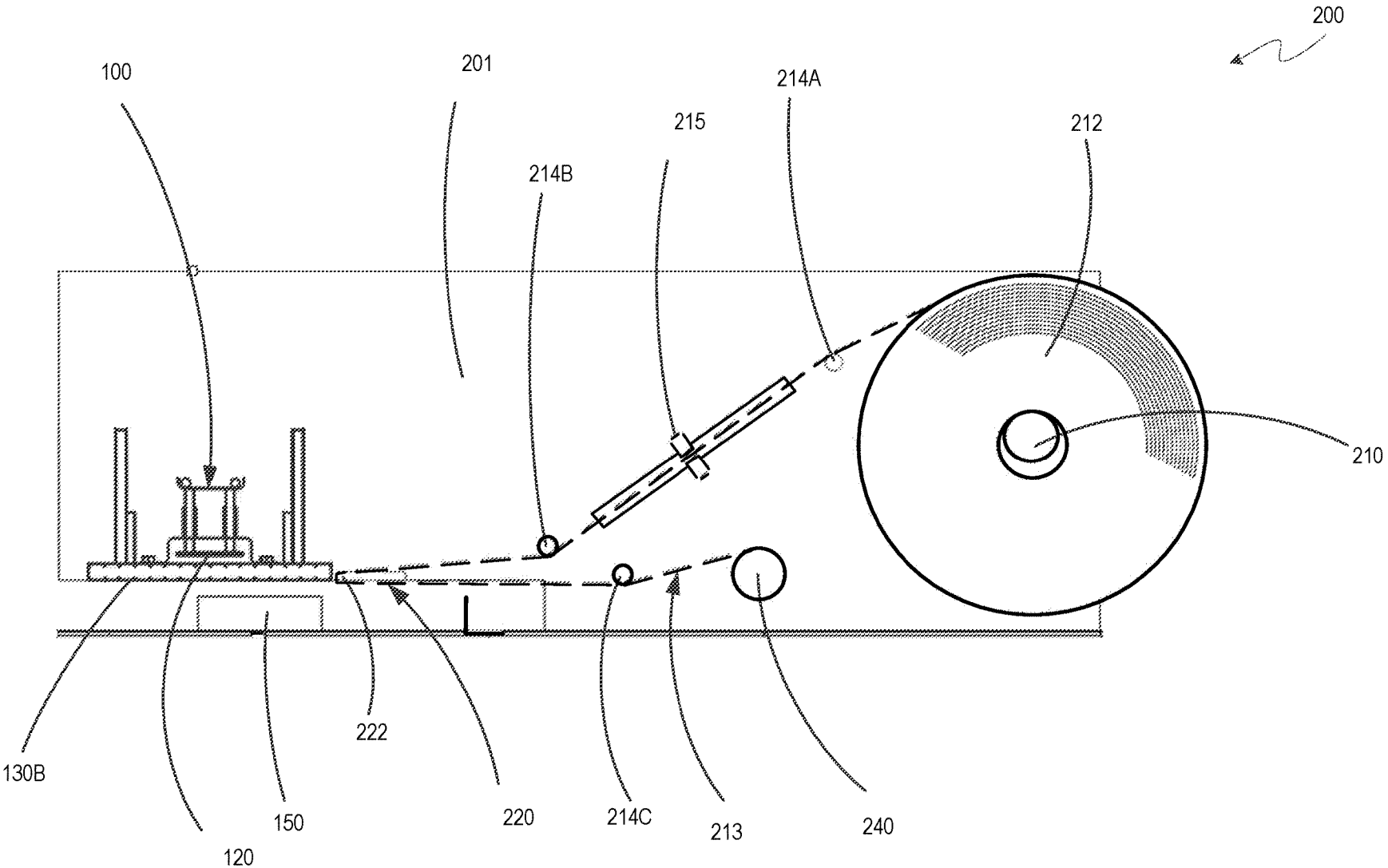
FIG. 2 illustrates a side view of a label-affixing device in accordance with some embodiments of the present disclosure.

FIG. 2 illustrates a side view of a label-affixing device 200 (e.g., label-affixing device 100 of FIGS. 1A-B) in accordance with some embodiments of the present disclosure. In some embodiments, features with similar reference numbers have the same or similar structure or functionality as corresponding features in FIGS. 1A-1B. The label-affixing device 200 may include a labeler mounting panel 201 and a peel assembly 220. The label-affixing device 200 may include a mounting assembly. The mounting assembly may be used for mounting and supporting various parts of the label assembly and the strip of labels. For example, a mounting assembly may include a labeler mounting panel 201. In some implementations, a spool holder 210 may be attached to the labeler mounting panel 201. A label 140 (e.g., label 140 of FIGS. 1A-B) may be supplied or stored on a label roll 212. In some embodiments, label 140 is a self-adhesive label. Label 140 may be coated with an adhesive coating on one face ("adhesive side"). Label 140 may be mounted on a continuous strip 213 that includes the adhesive label 140 and backing material. In other embodiments, the label 140 may not be mounted on a continuous strip of backing material, but can be wound about itself (such as on a spool or a wheel). In such cases, the label-affixing device 200 may not include the peel assembly 220.

To set up the label-affixing device 200 for applying labels, label roll 212 may be mounted on spool holder 210. In some examples, label-affixing device 200 may include one or more guide rollers 214 and a light sensor gap detector 215. Guide rollers 214 may be used for guiding the strip 213 through the label-affixing device 200 toward peel assembly 220. A gap detector 215 (e.g., a light sensor gap detector) may be used to detect a gap between two labels on strip 213. Strip 213, including the adhesive label 140, may be pulled over one of the guide rollers 214A and through light sensor gap detector 215. Strip 213 may be fed through (e.g., passed under) another guide roller 214B.

The label-affixing device 200 may include a peel assembly 220. The peel assembly 220 may be used to remove labels 140 from backing material they are attached to. In an implementation, strip 213 may be fed through peel assembly 220. In some examples, strip 213 may be pulled over a first face, corresponding to an upper surface of the peel bar 222 on which the adhesive label is not yet separated from the backing material. The strip 213 includes both the adhesive label and the backing material. The strip 213 can be pulled over the first face of the peel bar 222 before wrapping under the opposite face of peel bar 222. At this point, the adhesive label 140 separates from the backing material and slides into the channel slides 130A and 130B. Strip 213 may be passed through another guide roller 214C and end at a winding spool 240. Channel slides 130A and 130B may be positioned adjacent to the peel assembly 220. Channel slides 130A and 130B may be used to secure adhesive label 140 after adhesive label 140 is removed from strip 213. The channel slides 130A and 130B may be designed to restrict a curvature of the adhesive label 140 while restraining the adhesive label 140 in place. The channel slides 130A and 130B may be allowed to contact an adhesive side of adhesive label 140. The channel slides 130A and 130B provide for minimal contact with the adhesive side of the label 140.

The channel slides 130A and 130B secure the adhesive label 140 prior to being applied, in a position such that the adhesive label 140 can be applied to the object 150 by an applied pressure by the tamp pad. In one embodiment, the adhesive label 140 is removed from the strip 213 by the peel bar 222. The channel slides 130A and 130B hold the adhesive label 140 in an appropriate location to be applied, such that when held by the channel slides 130A and 130B, the adhesive label 140 is held in a substantially symmetric position between the channel slides 130A and 130B, and is also located above the object 150.

By applying pressure to the plate 110, e.g., by an actuator, a motor, manually, or the like, the shape-conforming tamp pad 120 moves from the first position (illustrated in FIG. 1A) to the second position (illustrated in FIG. 1B) and applies the label 140 to the object 150. The shape-conforming tamp pad 120 has appendages (e.g., flexible fingers) on the contacting face of the pad that individually deform and compress with little resistance. In some embodiments, the shape-conforming tamp pad 120 conforms to the surface profile of the object 150 without applying excessive pressure to the object to prevent damaging (e.g., crushing, breaking, deforming) the object 150 during the label application process. Although the mechanism in FIG. 2 for securing the label is depicted as a channel slide mechanism, in other embodiments, the label-affixing device 200 can include other mechanisms for holding the label, such as air suction, adhesive, surface tension, electrostatic charge, or the like. In each case, the mechanism for securing the label can secure the label between the first position and the second position. The appendages can be designed to individually compress and/or individually deform in order to apply an adhesive label to a surface (that can be planar, non-planar, rigid, compressible, or the like). The appendages can apply the adhesive label responsive to the plate moving from the first position to the second position, as described above.

FIGS. 3A-3H illustrate various shape-conforming tamp pads in accordance with some embodiments of the present disclosure.

FIG. 3A illustrates a shape-conforming tamp pad 320A that has appendages 328 that are substantially cylindrical (e.g., have a circular perimeter or have a substantially circular cross section) and that have a substantially uniform size (e.g., circumference, diameter, width, length, and/or the like) and a substantially uniform spacing across the bottom surface of the base structure 322. The appendages 328 extend from a base structure 322, and are designed to individually deform, compress, bend, or flex, in order to apply the adhesive label to the surface of an object.

Although depicted as having a circular perimeter (e.g., cross section), in other embodiments, the appendages can have perimeters of other shapes, such as square, rectangular, elliptical, hexagonal, triangular, or the like. The appendages can have various properties, and/or features. For example, in some embodiments, the appendages can be hollow, solid, or a combination of both. In other embodiments, the appendages can have one or more cavities or recesses. In the case where at least a portion of the appendages are hollow, the hollow portions of the appendages can be filled with air, gas, liquid, oil, gel, etc. The appendages 328 and the shape-conforming tamp pad 320A can be made of a flexible material, such as silicone, silicon rubber, plastic, foam, bristles, or the like. The appendages 328 and/or the shape-conforming tamp pad 320A can have a Shore 00 hardness of approximately 10 in order to be sufficiently compressible and/or deformable (e.g., via elastic deformation) to apply the adhesive label to the object without damaging the object. In some cases, different materials can be used, depending on the object to which the adhesive label is to be applied. In some embodiments, different appendages can be made of a different material, or can have different properties or features. For example, in some embodiments, a first subset of the appendages can be hollow while a second subset of the appendages can be solid. In further or other embodiments, a first subset of the appendages can be made of a first material and a second subset of the appendages can be made of a second material.

In some embodiments, the appendages can be made of a material and/or mechanism that is a spring (for example, plastic springs or metal springs). In some embodiments, a first set of the appendages 328 can have a first hardness and a second set of the appendages 328 can have a second hardness that is less than the first hardness. In some embodiments, there can be more than two sets of appendages 328, with each set having a different hardness.

In further embodiments, the first set of appendages 328 can be located closer to the perimeter of the lower surface of the base structure than the second set of the appendages. In other embodiments, the reverse may be more beneficial, in that the second set of appendages 328 can be located closer to the perimeter and the first set of appendages 328 can be located closer to the center.

In some embodiments, the appendages 328 can be non-uniform in cross-sectional area (e.g., the appendages may be cone shaped or pyramid shaped).

FIG. 3B illustrates a shape-conforming tamp pad 320B that has appendages 328 arranged closer to one another around the perimeter of the base structure 322 than they are to each other in the middle of the base structure 322. In one embodiment, a first spacing distance of a first set of appendages is less than a second spacing distance of a second set of appendages. In other words, some appendages may be spaced differently from other appendages. In some embodiments, an inter-appendage spacing may vary between any two appendages.

FIG. 3C illustrates a shape-conforming tamp pad 320C that has appendages 328 that have a non-circular cross-section (e.g., non-cylindrical, substantially square perimeter, substantially rectangular perimeter, etc.) and that have a substantially uniform size and a substantially uniform spacing across the bottom surface of the base structure 322. Additional variations or combinations of the embodiments described may be apparent to one skilled in the art. In some embodiments, a shape-conforming tamp pad has one or more appendages with a cross section of a first shape (e.g., circular, elliptical, square, rectangular, triangular, hexagonal, or the like) and one or more appendages of a second shape that is different from the first shape. Additionally or alternatively, shapes of appendages may include one or more of substantially cylindrical, substantially circular perimeter, substantially square perimeter, substantially rectangular perimeter, substantially triangular perimeter, substantially hexagonal perimeter, etc. In some embodiments, the appendages have a variable spacing distance between a subset of the appendages (e.g., some appendages are grouped close together while other appendages are spaced farther apart).

FIG. 3D illustrates the side view of a shape-conforming tamp pad 320D that has appendages 328 that extend from the bottom of a base structure 322. The appendages 328 vary in length, which may allow the pad 320D to better conform to the surface of an object (e.g., a convex upper surface of an object). However, in other embodiments, the appendages 328 can vary in length, such that the appendages that are closer to a central region of the base structure 322 are longer while the appendages that are closer to a perimeter of the base structure 322 are shorter, allowing the shape-conforming tamp pad 320D to better conform to a concave upper shape of an object. In still other embodiments, the appendages 328 can vary in length such that the appendages closer to a first side of the lower side of the base structure are shorter than the appendages closer to a second side of the lower side of the base structure, allowing the shape-conforming tamp pad 320D to better conform to a sloped or slanted upper shape of an object.

FIG. 3E illustrates the side view of a shape-conforming tamp pad 320E that has appendages 328 that extend from the bottom of a base structure 322. The appendages 328 vary in width and/or thickness (e.g., cross-sectional area), which may allow the pad 320E to better apply pressure to certain areas of the label as it is pressing against (e.g., applying pressure to) a surface of the object (e.g., a concave upper surface of an object).

FIG. 3F illustrates a cross-sectional view of a shape-conforming tamp pad 320F that has appendages 328 that extend from the bottom of a base structure 322. The appendages 328 form a cavity (e.g., are hollow) and channels that run through the base structure 322 align with the cavities in the appendages 328. In some embodiments, the cavities in the appendages 328 and the channels in the base structure 322 are left open to atmosphere. In some embodiments, the cavities in the appendages 328 (e.g., and the corresponding channels in the base structure 322) are filled with one or more fluids (e.g., a liquid, a gas, air, etc.). In some embodiments, different cavities in the appendages 328 (e.g., and the corresponding channels in the base structure 322) are filled with different fluids (e.g., different types of fluids, different pressures of the same fluid, fluids with different viscosities, etc.) to adjust the hardness or flexibility of the appendages 328. In some embodiments, the appendages 328 are uniformly filled, non-uniformly filled, or left empty. In some embodiments, a cavity of an appendage 328 (e.g., and corresponding channel of the base structure 322) forms a sealed environment (e.g., is covered by a material, covered by a component, has a material partially embedded in the channel and/or cavity, etc.).

FIG. 3G illustrates a cross-sectional view of a shape-conforming tamp pad 320G that has appendages 328 that extend from the bottom of a base structure 322. The appendages 328 form a hollow cavity (e.g., in the center of each appendage 328). This may reduce the amount of force to compress and/or deform each individual appendage such that the shape-conforming tamp pad can conform to the surface of an object.

The shape-conforming tamp pad 320 may also be configured with plastic springs or metal springs instead of solid appendages or hollow appendages. The shape-conforming tamp pad 320 may be made out of a silicon rubber (e.g., platinum cured silicone rubber), a soft plastic, or another compressible and/or deformable material with a Shore 00 hardness between 10 and 60 (e.g., polyurethane foam, ethylene-vinyl acetate (EVA) foam). Additionally or alternatively, the appendages can be constructed with Ecoflex silicone (or a similar type of silicone rubber), such as by Smooth-on Inc. that is a silicone that can be mixed and cured, while maintaining properties such as being stretchy, soft, flexible, etc.

FIG. 3H illustrates a cross-sectional view of a shape-conforming tamp pad 320H that has a sheet 330 fixed to the appendages 328. The shape-conforming tamp pad 320H can be any of the shape-conforming tamp pads described herein. The sheet 330 can be fixed to ends of the appendages 328 opposite to the base structure 322. The sheet 330 can be a plastic sheet, such as a polyethylene sheet, or can be a thin EVA foam. In some embodiments, the sheet 330 can be fixed to the ends of the appendages 328 via adhesive or glue. In some embodiments, the sheet 330 can be integral to the appendages 328.

The sheet 330 can allow a label, such as the adhesive label 140, to slide (e.g., along the bottom surface of the shape-conforming tamp pad 320H) without getting tangled in the appendages 328 or caught on the ends of the appendages 328.

Figure 4:
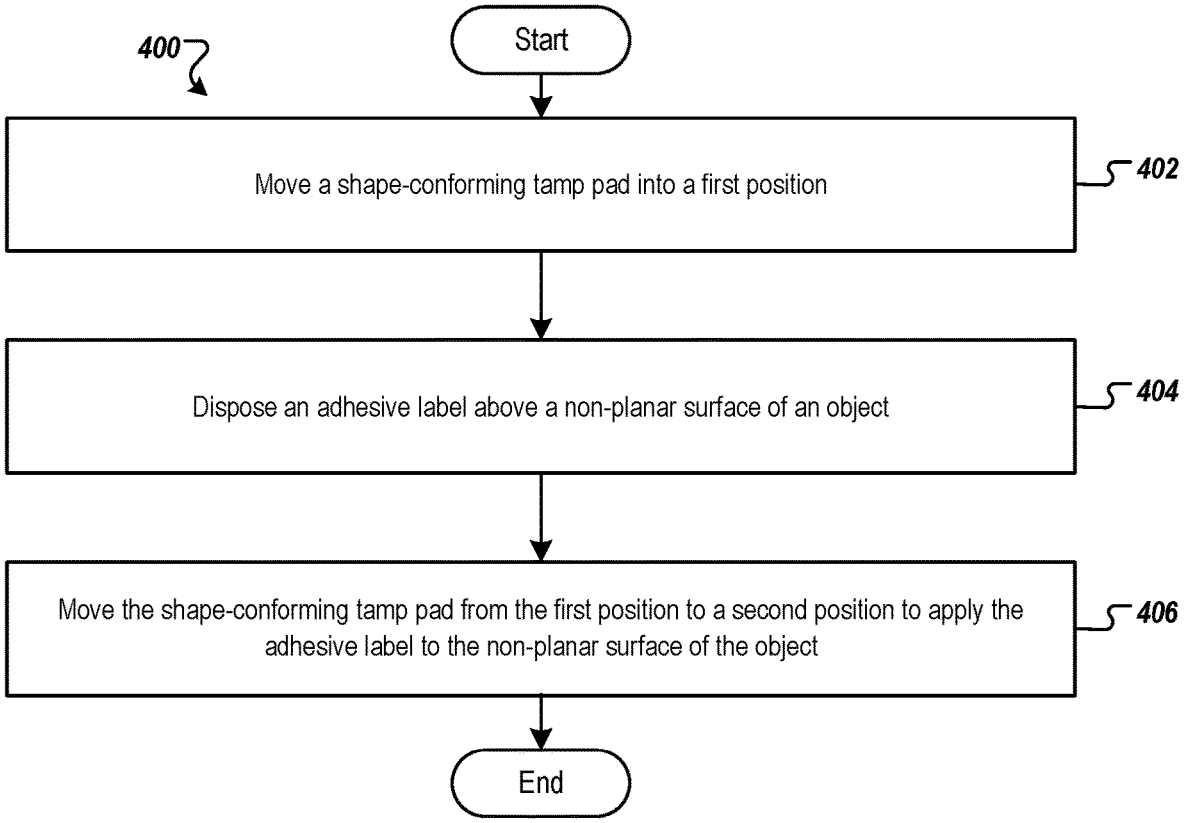
FIG. 4 illustrates a method of applying an adhesive label to an object using a label-affixing device in accordance with some embodiments of the present disclosure.

FIG. 4 illustrates a method 400 of applying an adhesive label to an object using a label-affixing device in accordance with some embodiments of the present disclosure.

In some embodiments, method 400 is performed by processing logic that includes hardware (e.g., circuitry, dedicated logic, programmable logic, microcode, processing device, etc.), software (such as instructions run on a processing device, a general purpose computer system, or a dedicated machine), firmware, microcode, or a combination thereof. In some embodiments, a non-transitory storage medium stores instructions that when executed by a processing device (e.g., of label-affixing device 100 of FIGS. 1A-B, label-affixing device 200 of FIG. 2, etc.) cause the processing device to perform one or more operations of method 400. In some embodiments, one or more operations of method 400 are performed by the label-affixing device (e.g., label-affixing device 100 of FIGS. 1A-B, label-affixing device 200 of FIG. 2, etc.). In some embodiments, one or more operations of method 400 are performed via automated operation of the label-affixing device and/or one or more operations of method 400 are performed via manual operation of the label-affixing device.

For simplicity of explanation, method 400 is depicted and described as a series of operations. However, operations in accordance with this disclosure can occur in various orders and/or concurrently and with other operations not presented and described herein. Furthermore, not all illustrated operations are performed to implement method 400 in accordance with the disclosed subject matter. In addition, those skilled in the art will understand and appreciate that method 400 could alternatively be represented as a series of interrelated states via a state diagram or events.

At block 402, a shape-conforming tamp pad is moved into a first position. In some embodiments however, the shape-conforming tamp pad can already be located in the first position. The shape-conforming tamp pad can be attached to a plate, such as the plate 110 of FIG. 1, which is coupled to an actuator of the shape-conforming tamp pad. The actuator can be manual, automated, or a combination of the two. The actuator can include a means for receiving power as well as a control signal, for example, from the processing device that can control the actuator to move from the first position to the second position, from the second position to the first position, or to another position between the first position and the second position. The actuator can be controlled via a mechanical system, an electronic system, a user input, or the like. A power source from which the actuator can receive power can be an electric current, hydraulic fluid pressure, pneumatic pressure, or the like.

At block 404, an adhesive label is disposed above the non-planar surface of an object. In some embodiments, the adhesive label may be disposed above a planar surface, a recessed surface of, a convex surface, or a more complicated surface of the object. The adhesive label can be held by channel slides, such as the channel slides 130A and 130B of FIG. 1, above the surface of an object. In such a case, the adhesive label can be transported to an appropriate location to be secured by the channel slides by a motorized wheel that holds a set of adhesive labels (e.g., on a spool), for example without the use of air suction to secure the adhesive label to the surface of the object. In other embodiments, the adhesive label can be manually placed and secured by the channel slides by a user of the label-affixing device. In other embodiments, the adhesive label can be secured above the surface of the object by other means including pneumatic pressure, additional adhesive, surface tension, clamps, or the like.

In some embodiments, the adhesive label can be secured such that an upper side (e.g., a non-adhesive side) of the adhesive label is in contact with appendages of the shape-conforming tamp pad. In other embodiments, the adhesive label can be secured such that the upper side of the adhesive label is located at a distance from the appendages of the shape-conforming tamp pad.

At block 406, the shape-conforming tamp pad is moved from the first position to a second position to apply the adhesive label to the surface of the object. In order to apply the adhesive label to the surface of the object, the actuator can move the plate into the second position, such that a lower surface of the shape-conforming tamp pad substantially conforms its shape to match the shape of the surface object. For example, the appendages of the shape-conforming tamp pad can be individually compressed, deformed, and/or flexed to conform to the surface of the object, allowing pressure to be applied to all or most of the adhesive label.

In some embodiments, the shape-conforming tamp pad is made of a silicone rubber or plastic. In some embodiments, the shape-conforming tamp pad has a Shore 00 hardness of approximately 10. In some embodiments, the appendages can be made of silicone rubber, plastic, metal springs, plastic springs, or the like, such that they can be individually compressed and/or individually deformed. The appendages can be integral to a base structure of the tamp pad, or the appendages can be affixed to the base structure of the tamp pad.

The shape-conforming tamp pad can include appendages that are non-uniform across a lower surface of the shape-conforming tamp pad. In some embodiments, each appendage can have a different length and/or cross-sectional area. For example, a first subset of the appendages can have a first length, a second subset of the appendages can have a second length, etc. In some embodiments, each appendage can have a different hardness (e.g., Shore 00 hardness). For examples, a first subset of the appendages can have a first hardness, a second subset of the appendages can have a second hardness, etc.

Additionally or alternatively, the appendages can be located in a non-uniform pattern across the lower surface of the shape-conforming tamp pad. For example, a first spacing distance of a first subset of the appendages can be located closer to a perimeter of the lower surface of the base structure than a second subset of the appendages. A first spacing distance of a subset of the appendages can be less than a second spacing distance of another subset of the plurality of appendages. In other embodiments, the appendages can be located in a lattice pattern, such as a square grid pattern, a rectangular grid pattern, a hexagonal grid pattern, a honeycomb grid pattern, or the like on the lower surface of the base structure.

In further embodiments, the appendages can be either solid or hollow. In the case where the appendages are hollow (or partially hollow), the hollow portion can be filled with a liquid, gas, or different material (compared to the material out of which the appendage is made).

In further embodiments, the appendages can have varying shapes. The cross-sectional areas can vary between appendages (e.g., between elliptical, circular, rectangular, triangular, and/or the like), or the shape of the appendages themselves can be varied (e.g., between cylindrical, conical, pyramidal, and/or the like).

In the foregoing specification, implementations of the disclosure have been described with reference to specific example implementations thereof. It will be evident that various modifications may be made thereto without departing from the broader spirit and scope of implementations of the disclosure as set forth in the following claims. The specification and drawings are, accordingly, to be regarded in an illustrative sense rather than a restrictive sense. It should be borne in mind, however, that all of these and similar terms are to be associated with the appropriate physical quantities and are merely convenient labels applied to these quantities.

The preceding description sets forth numerous specific details such as examples of specific systems, components, methods, and so forth in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

The terms "over," "under," "between," "disposed on," and "on" as used herein refer to a relative position of one material layer or component with respect to other layers or components. For example, one layer disposed on, over, or under another layer may be directly in contact with the other layer or may have one or more intervening layers. Moreover, one layer disposed between two layers may be directly in contact with the two layers or may have one or more intervening layers. Similarly, unless explicitly stated otherwise, one feature disposed between two features may be in direct contact with the adjacent features or may have one or more intervening layers.

The words "example" or "exemplary" are used herein to mean serving as an example, instance or illustration. Any aspect or design described herein as "example' or "exemplary" is not necessarily to be construed as preferred or advantageous over other aspects or designs. Rather, use of the words "example" or "exemplary" is intended to present concepts in a concrete fashion.

Reference throughout this specification to "one embodiment," "an embodiment," or "some embodiments" means that a particular feature, structure, or characteristic described in connection with the embodiment is included in at least one embodiment. Thus, the appearances of the phrase "in one embodiment," "in an embodiment," or "in some embodiments" in various places throughout this specification are not necessarily all referring to the same embodiment. In addition, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Also, the terms "first," "second," "third," "fourth," etc. as used herein are meant as labels to distinguish among different elements and can not necessarily have an ordinal meaning according to their numerical designation. When the term "about," "substantially," or "approximately" is used herein, this is intended to mean that the nominal value presented is precise within ±10%.

Although the operations of the methods herein are shown and described in a particular order, the order of operations of each method may be altered so that certain operations may be performed in an inverse order so that certain operations may be performed, at least in part, concurrently with other operations. In another embodiment, instructions or sub-operations of distinct operations may be in an intermittent and/or alternating manner.

It is understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A label-affixing device comprising:

a plate configured to move between a first position and a second position; and a shape-conforming tamp pad comprising:

a base structure comprising a first surface and a second surface opposite the first surface, wherein the first surface is mounted to the plate; and a plurality of appendages extending from the second surface of the base structure, wherein each of the plurality of appendages comprises a body that has a first distal end and a second distal end, the first distal end being coupled to the second surface of the base structure, the second distal end configured to contact an adhesive label, wherein the plurality of appendages are configured to at least one of individually compress or individually deform to apply the adhesive label to a non-planar surface of an object responsive to the plate moving from the first position to the second position.

2. The label-affixing device of claim 1, wherein the label-affixing device is configured to apply the adhesive label to the non-planar surface without using air suction to secure the adhesive label to the shape-conforming tamp pad.

3. The label-affixing device of claim 1, further comprising a pair of channel slides configured to position the adhesive label between the shape-conforming tamp pad and the object.

4. A shape-conforming tamp pad comprising:

a base structure comprising a lower surface; and a plurality of appendages extending from the lower surface, wherein each of the plurality of appendages comprises a body that has a first distal end and a second distal end, the first distal end being coupled to the lower surface of the base structure, the second distal end configured to contact an adhesive label, wherein the plurality of appendages are configured to at least one of individually compress or individually deform to apply the adhesive label to a non-planar surface of an object.

5. The shape-conforming tamp pad of claim 4, wherein one or more of:

the shape-conforming tamp pad is made of a silicon rubber or plastic; or the shape-conforming tamp pad has a Shore 00 hardness of about 10.

6. The shape-conforming tamp pad of claim 4, wherein the plurality of appendages comprise metal springs or plastic springs.

7. The shape-conforming tamp pad of claim 4, wherein a first subset of the plurality of appendages has a first hardness and a second subset of the plurality of appendages has a second hardness that is less than the first hardness.

8. The shape-conforming tamp pad of claim 7, wherein the first subset of the plurality of appendages is disposed closer to a perimeter of the lower surface of the base structure than the second subset of the plurality of appendages.

9. The shape-conforming tamp pad of claim 4, wherein a first spacing distance of a first subset of the plurality of appendages is less than a second spacing distance of a second subset of the plurality of appendages.

10. The shape-conforming tamp pad of claim 9, wherein the first subset of the plurality of appendages is disposed closer to a perimeter of the lower surface of the base structure than the second subset of the plurality of appendages.

11. The shape-conforming tamp pad of claim 4, wherein at least a subset of the plurality of appendages are filled with liquid or gas.

12. The shape-conforming tamp pad of claim 4, wherein at least a subset of the plurality of appendages are hollow.

13. The shape-conforming tamp pad of claim 4, wherein each appendage of a first subset of the plurality of appendages has a first shape and each appendage of a second subset of the plurality of appendages has a second shape that is different from the first shape.

14. The shape-conforming tamp pad of claim 4, wherein each appendage of a first subset of the plurality of appendages has a first thickness and each appendage of a second subset of the plurality of appendages has a second thickness that is different from the first thickness.

15. The shape-conforming tamp pad of claim 4, wherein each appendage of a first subset of the plurality of appendages has a first length and each appendage of a second subset of the plurality of appendages has a second length.

16. The shape-conforming tamp pad of claim 4, wherein each appendage of the plurality of appendages is substantially cylindrical.

17. The shape-conforming tamp pad of claim 4, wherein one or more of:

a first hardness of a first appendage of the plurality of appendages is different than a second hardness of a second appendage of the plurality of appendages;

a first spacing distance of a first subset of the plurality of appendages is different from a second spacing distance of a second subset of the plurality of appendages;

a first shape of the first appendage is different from a second shape of the second appendage; or a first thickness of the first appendage is different from a second thickness of the second appendage.

18. A method comprising:

disposing an adhesive label above a surface of an object; and moving a shape-conforming tamp pad of a label-affixing device from a first position to a second position to cause a plurality of appendages extending from a lower surface of a base structure of the shape-conforming tamp pad to at least one of individually compress or individually deform to apply the adhesive label to the surface of the object, wherein each of the plurality of appendages comprises a body that has a first distal end and a second distal end, the first distal end being coupled to the lower surface of the base structure, the second distal end configured to contact the adhesive label.

19. The method of claim 18, wherein the label-affixing device is configured to apply the adhesive label to the surface without using air suction to secure the adhesive label to the shape-conforming tamp pad, wherein the surface of the object is non-planar.

20. The method of claim 18, wherein the disposing of the adhesive label above the surface of the object is via a pair of channel slides of the label-affixing device.

* * * * *